US011959350B2

(12) United States Patent
Evans

(10) Patent No.: US 11,959,350 B2
(45) Date of Patent: Apr. 16, 2024

(54) RELEASE LUGS FOR A JARRING DEVICE

(71) Applicant: Robert W. Evans, Montgomery, TX (US)

(72) Inventor: Robert W. Evans, Montgomery, TX (US)

( * ) Notice: Subject to any disclaimer, the term of this patent is extended or adjusted under 35 U.S.C. 154(b) by 0 days.

(21) Appl. No.: 17/576,088

(22) Filed: Jan. 14, 2022

(65) Prior Publication Data

US 2022/0136355 A1 May 5, 2022

Related U.S. Application Data

(63) Continuation of application No. 16/824,179, filed on Mar. 19, 2020, now Pat. No. 11,230,901, which is a continuation of application No. 16/168,610, filed on Oct. 23, 2018, now Pat. No. 10,669,800, which is a continuation-in-part of application No. 14/621,577, filed on Feb. 13, 2015, now Pat. No. 10,202,815.

(51) Int. Cl.

| | |
|---|---|
| ***E21B 31/107*** | (2006.01) |
| ***E21B 23/00*** | (2006.01) |
| ***E21B 31/113*** | (2006.01) |

(52) U.S. Cl.

CPC ..... *E21B 31/1135* (2013.01); *E21B 23/006* (2013.01); *E21B 31/107* (2013.01)

(58) Field of Classification Search

CPC ..... E21B 31/107; E21B 31/1075; E21B 31/1135; E21B 31/113

See application file for complete search history.

(56) References Cited

U.S. PATENT DOCUMENTS

| | | | |
|---|---|---|---|
| 1,020,815 | A | 3/1912 | Fielding, Jr. |
| 2,065,135 | A | 3/1927 | Sumter et al. |
| 2,008,743 | A | 7/1935 | Sumter |
| 2,047,209 | A | 7/1936 | Lawlor |
| 2,618,466 | A | 11/1952 | Bagnell et al. |
| 2,618,467 | A | 11/1952 | Bagnell et al. |
| 2,903,241 | A | 9/1959 | Brown |
| 3,050,131 | A | 8/1962 | Siracusa |
| 3,371,730 | A | 3/1968 | Newman |
| 3,414,061 | A | 12/1968 | Nutter |
| 3,606,926 | A | 9/1971 | Schwegman |
| 3,658,140 | A | 4/1972 | Berryman |
| 3,685,599 | A | 8/1972 | Kisling |
| 3,709,478 | A | 1/1973 | Kisling, III |
| 3,797,591 | A | 3/1974 | Berryman |
| 4,036,312 | A | 7/1977 | DeLuish |

(Continued)

FOREIGN PATENT DOCUMENTS

| | | |
|---|---|---|
| WO | 2016130308 | 8/2016 |

OTHER PUBLICATIONS

International Search Report and Written Opinion for Application No. PCT/US16/15161 dated Jul. 11, 2016.

(Continued)

*Primary Examiner* — Kipp C Wallace

(74) *Attorney, Agent, or Firm* — Tumey L.L.P.

(57) ABSTRACT

A release mechanism for a jarring tool is formed by a plurality of segmented release lugs. Each lug includes a plurality of axial spaced projections on an inner surface and a plurality of grooves on an outer surface. The projections have either different widths or are separated by varying distances and releaseably engage corresponding grooves in a mandrel located within a housing of the tool. The release lugs are positioned between a trigger sleeve and the mandrel.

15 Claims, 7 Drawing Sheets

(56) References Cited

U.S. PATENT DOCUMENTS

| | | | |
|---|---|---|---|
| 4,376,468 | A | 3/1983 | Clark |
| 5,022,473 | A | 6/1991 | Taylor |
| 5,069,282 | A | 12/1991 | Taylor |
| 5,133,404 | A | 7/1992 | Dollison |
| 5,330,018 | A | 7/1994 | Griffith |
| 5,624,001 | A | 4/1997 | Evans |
| 6,290,004 | B1 | 8/2001 | Evans |
| 6,948,560 | B2 | 9/2005 | Marsh |
| 7,510,008 | B2 | 3/2009 | Evans |
| 8,205,690 | B2 | 6/2012 | Evans |
| 8,720,540 | B2 | 5/2014 | Gano |
| 10,408,009 | B2 | 9/2019 | Wallace |
| 2005/0087338 | A1 | 8/2005 | Parker |
| 2005/0183889 | A1 | 8/2005 | Marsh |
| 2006/0169456 | A1 | 8/2006 | Evans |
| 2015/0144358 | A1 | 5/2015 | Mejia et al. |
| 2015/0226031 | A1 | 8/2015 | Hekelaar |
| 2016/0024886 | A1 | 1/2016 | Williamson |
| 2016/0237771 | A1 | 8/2016 | Evans |
| 2018/0252064 | A1 | 9/2018 | Evans |
| 2019/0055804 | A1 | 2/2019 | Evans |

OTHER PUBLICATIONS

USPTO Final Office Action for U.S. Appl. No. 14/621,577 dated Jul. 6, 2018.
USPTO Non-Final Office Action for U.S. Appl. No. 14/621,577 dated Feb. 22, 2018.
USPTO Non-Final Office Action for U.S. Appl. No. 14/621,577 dated May 10, 2017.
USPTO Final Office Action for U.S. Appl. No. 14/621,577 dated Aug. 28, 2017.
USPTO Notice of Allowance for U.S. Appl. No. 14/621,577 dated Oct. 1, 2018.
International Preliminary Report for International Patent Application No. PCT/US2016/015161 dated Aug. 15, 2017.
European Patent Office Search Report and Written Opinion for Application No. 16749589.4 dated Feb. 13, 2019.
USPTO Non-Final Office Action for U.S. Appl. No. 15/973,247 dated Jul. 11, 2018.
USPTO Final Office Action for U.S. Appl. No. 15/973,247 dated Dec. 12, 2018.
USPTO Notice of Allowance for U.S. Appl. No. 15/973,247 dated Apr. 29, 2019.
USPTO Non-Office Action for U.S. Appl. No. 16/168,610 dated May 24, 2019.
Extended European Search Report for Application No. EP 19172632 dated Oct. 23, 2019.
European Examination Report for Application No. 16749589.4 dated Oct. 28, 2019.
USPTO Notice of Allowance for U.S. Appl. No. 16/168,610 dated Dec. 11, 2019.
Extended European Search Report and Written Opinion for Application No. 19172632.2 dated Oct. 30, 2019.
USPTO Issue Notification for U.S. Appl. No. 16/168,610 dated May 13, 2020.
USPTO Issue Notification for U.S. Appl. No. 15/973,247 dated Aug. 21, 2019.
Extended European Search Report for Application No. 19200264.0 dated Mar. 25, 2020.
USPTO Issue Notification for U.S. Appl. No. 14/621,577 dated Jan. 23, 2019.
USPTO Non-Final Office Action for U.S. Appl. No. 16/534,778 dated Sep. 24, 2020.
European Examination Report for Application No. 19172632.2-1002 dated Jan. 1, 2021.
USPTO Notice of Allowance for Application No. 16/534,778 dated Apr. 16, 2021.
USPTO Issue Notification for U.S. Appl. No. 16/534,778 dated Aug. 11, 2021.
USPTO Final Office Action for U.S. Appl. No. 16/824,179 dated Mar. 30, 2021.
USPTO Notice of Allowance for U.S. Appl. No. 16/824,179 dated Sep. 7, 2021.
USPTO Non-Final Office Action for U.S. Appl. No. 16/250,836 dated Aug. 27, 2021.
USPTO Notice of Allowance for U.S. Appl. No. 16/250,836 dated Nov. 29, 2021.
European Examination Report for Application No. 19172632.2-1002 dated Jan. 29, 2021.
USPTO Issue Notification for U.S. Appl. No. 16/250,836 dated Jan. 5, 2022.
USPTO Notice of Allowance for U.S. Appl. No. 17/461,395 dated Jun. 15, 2022.

RELEASE LUGS FOR A JARRING DEVICE

This application is a continuation of U.S. patent application Ser. No. 16/824,179 filed Mar. 19, 2020 which is a continuation in part application of U.S. patent application Ser. No. 16/168,610 filed Oct. 23, 2018 which is a continuation in part application of U.S. patent application Ser. No. 14/621,577 filed Feb. 13, 2015, the entire contents of which are hereby incorporated herein by reference thereto.

BACKGROUND OF INVENTION

1. Field of the Invention

This invention is directed to a release mechanism for a mandrel of a jarring device commonly referred to as a jar. Jars are used in the well drilling industry to free downhole tools that may become lodged in a well. An upward or downward force can be supplied to a tubular string which includes the affected tool in order to break free the tool from the well bore.

2. Description of Related Art

Typically, a release mechanism in the form of an annular collet is provided which normally prevents axial movement of the mandrel. The mandrel is spring biased to move with significant force in an upward or downward direction. If a sufficient force is placed on the mandrel, the collet will release.

U.S. Pat. No. 5,022,473 discloses a release assembly which comprises a plurality of angular segments 62 and 162 that engage in slots 86 and 88, and 186 and 188 respectively. It has been found that this arrangement can result in the segments 62 and 162 becoming out of alignment which could result in the failure of the release mechanism. As disclosed in the patent, the jar requires two sets of release lugs to withstand the anticipated tensile load. In this design the two lug assemblies must be spaced further apart than the total travel of the jar to prevent the lower lug from inadvertently engaging the groove of the upper lug assembly. If a third lug assembly were necessary it would have to be spaced a distance greater than the jar stroke from the lower set. This would significantly increase the total length of the jar and also the cost.

BRIEF SUMMARY OF THE INVENTION

The present invention solves the above noted problem by providing a plurality of angular lug segments each of which has two or more projections that engage corresponding grooves in the mandrel.

In order to avoid misalignment or a jarring situation, the projections having either a differing width or are spaced at different distances. The grooves on the mandrel have a complimentary configuration as will be explained below.

BRIEF DESCRIPTION OF THE SEVERAL VIEWS OF THE DRAWING(S)

DETAILED DESCRIPTION OF THE INVENTION

Figure 1:
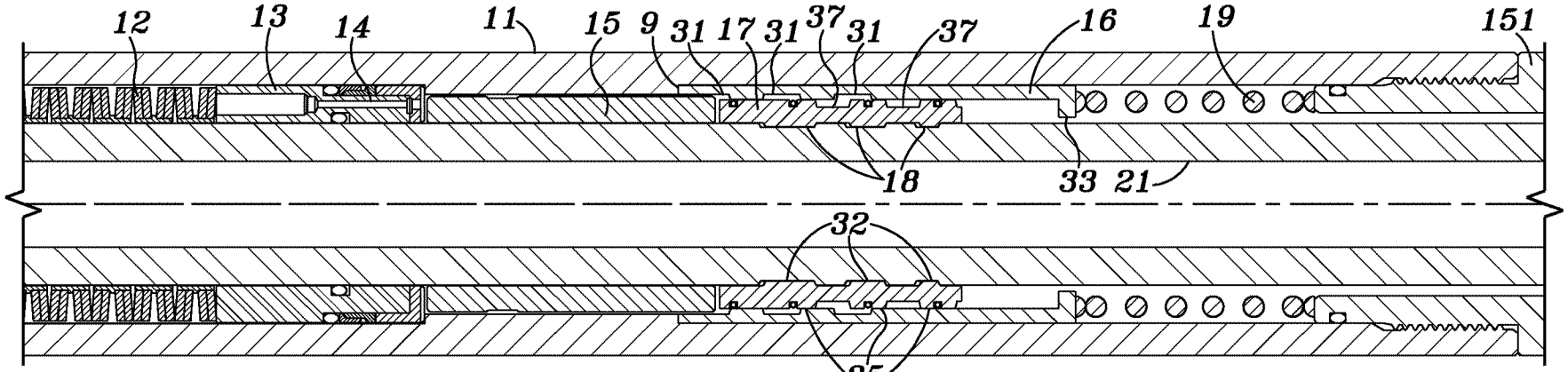
FIG. 1 is a cross-sectional view of a first embodiment of the release lugs as shown in a neutral position.
Figure 9:
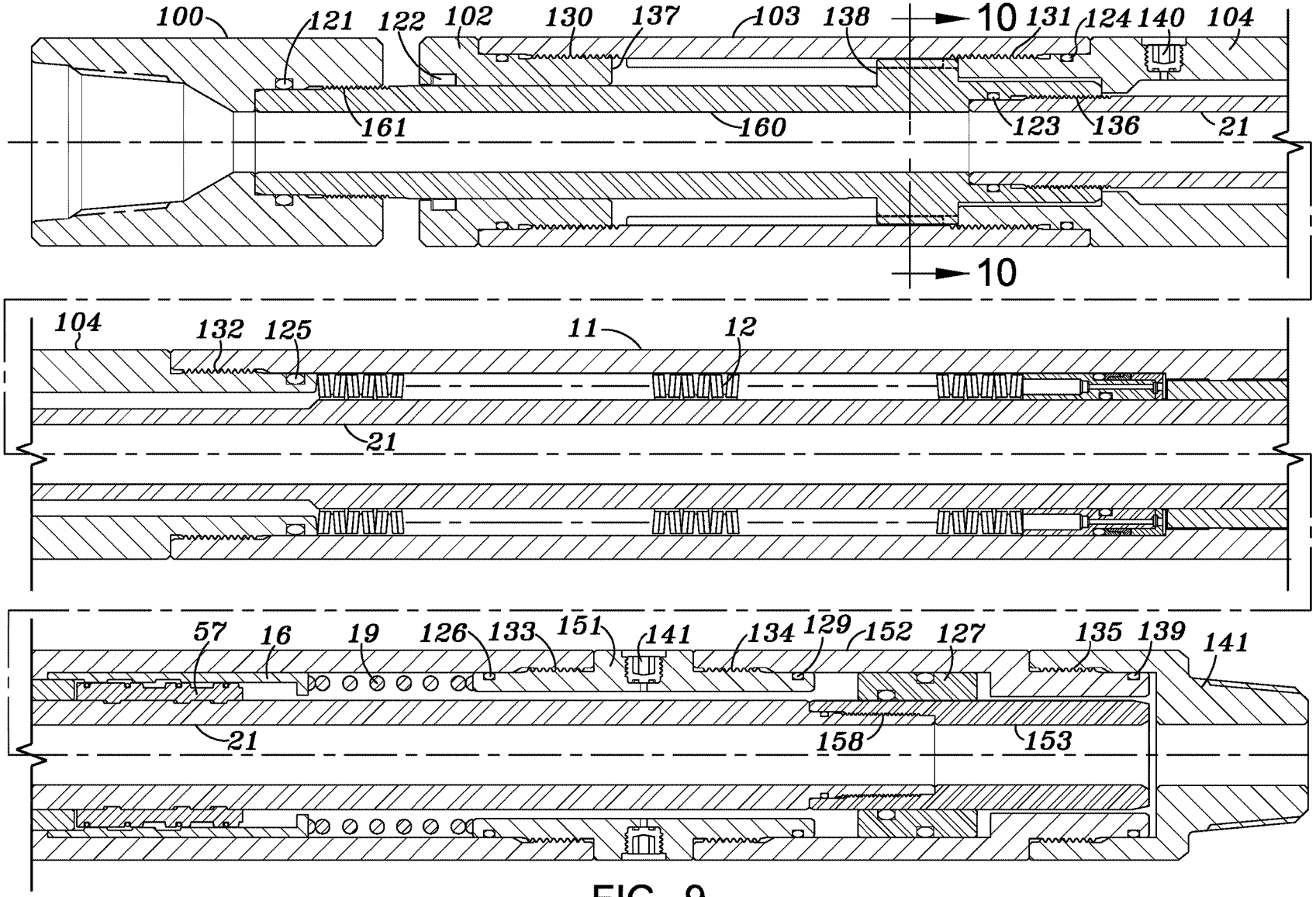
FIG. 9 is a segmented cross-sectional view of an entire jar including the release lugs of FIG. 7.

FIG. 1 illustrates a release mechanism including a plurality of release lugs 17 surrounding mandrel 21 of the jar such as that shown in FIG. 9.

The jar includes a central housing 11, a Belleville spring stack 12, an actuating piston comprising parallel flow passages which may comprise a restrictor orifice 14 and one or more check valves 13, an annular sleeve 15 surrounding mandrel 21 and an annular trigger sleeve 16 having an inwardly projecting lip 33. Annular trigger sleeve 16 is spring biased against a shoulder 9 provided in housing 11 by a spring 19 at lip 33. A lubricant fitting housing 151 is threadedly coupled to the downhole portion of housing 11.

Figure 4:
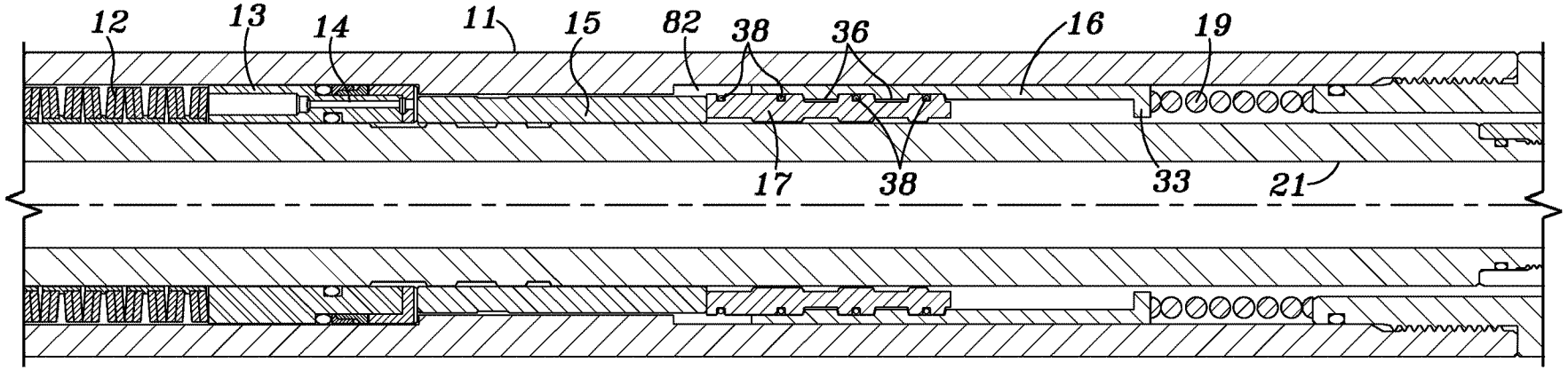
FIG. 4 is a cross-sectional view of the mandrel in a completely released position.
Figure 5:
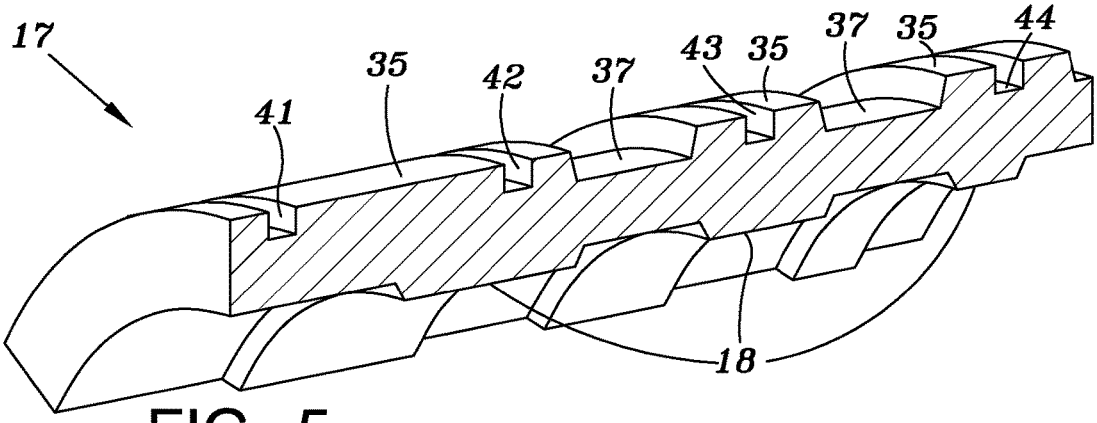
FIG. 5 is a perspective view of a release lug according to a first embodiment of the invention.
Figure 6:
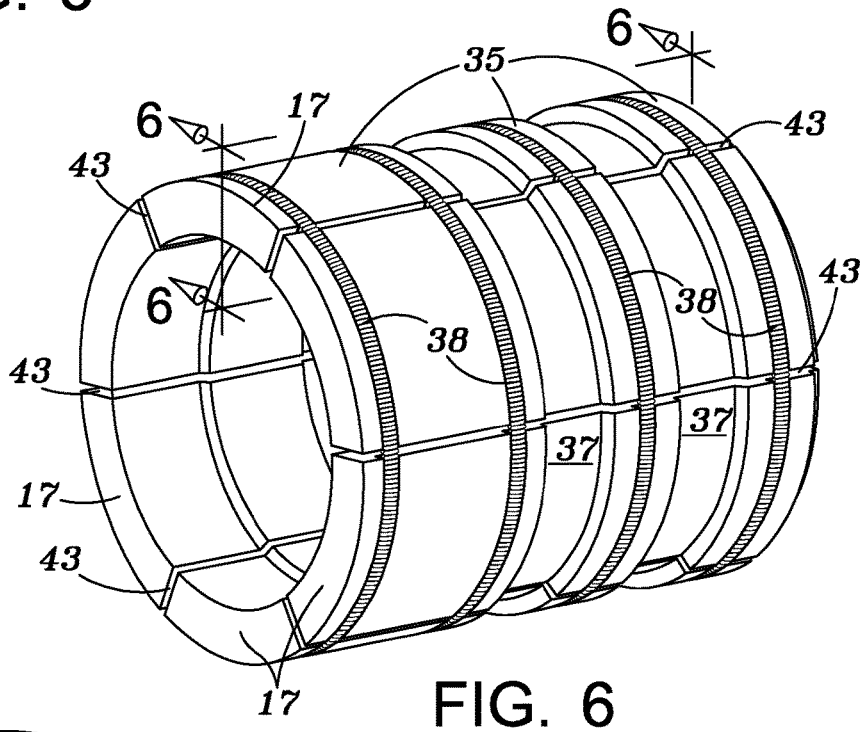
FIG. 6 is a perspective view of a plurality of release lugs forming a release mechanism according to a first embodiment of the invention.

As shown in FIG. 5, each release lug 17 includes a plurality of projections 18 of varying width on its interior surface. Projections 18 in this embodiment are evenly spaced from each other. The exterior surface of the release lug includes a plurality of grooves 37 which are adapted to receive projections 36 of the trigger sleeve 16 as shown in FIG. 4. A plurality of smaller grooves 41, 42, 43 and 44 are also provided on the exterior surface of release lugs 17 and are adapted to hold garter springs 38 as shown in FIG. 6. A plurality of the release lugs are used to form a release mechanism as shown in FIG. 6 having spaces 43 between the release lugs. Although six release lugs are shown any number of segments for example, 2 thru 12 may be used.

In the rest position shown in FIG. 1, surfaces 35 of the release lugs are in contact with the interior surface of trigger sleeve 16 and projections 18 are located within grooves 32 provided on the outer surface of mandrel 21. As an upward force is applied to mandrel 21 which would be from the left as shown in FIG. 1, mandrel 21 and release lugs 17 will travel to the left, thereby compressing Belleville spring stack 12. As the surfaces 35 align with grooves 31 of the trigger sleeve 16, the beveled surfaces of the projections and grooves of the trigger sleeve, release lugs and mandrel grooves will allow the surfaces to be forced outwardly into grooves 31 resulting in projections 18 disengaging from grooves 32 in the mandrel. The mandrel then is free to move in an upward direction or to the left as shown in FIG. 4. The overall operation of a hydraulic jar is well known and explained in U.S. Pat. Nos. 6,290,004 and 7,510,008, the entire contents of which are expressly incorporate herein by reference thereto.

In order to reload the jar, a downward force is placed on the mandrel which will move the mandrel downward. The garter springs 38 will cause the release lugs to return to their original position with the projections 18 in grooves 32.

Figure 7:
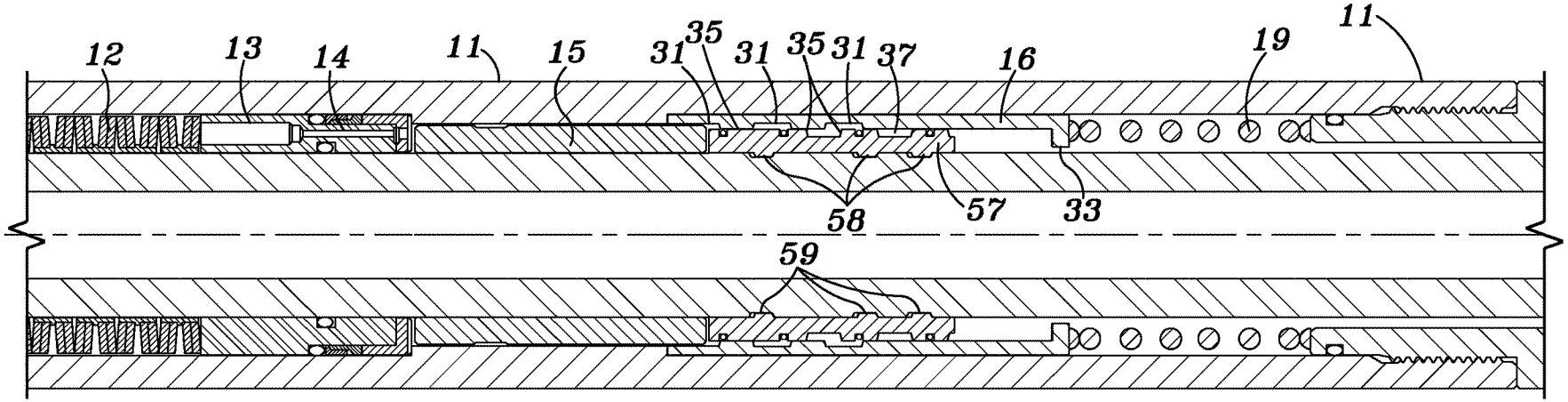
FIG. 7 is a cross-sectional view of a second embodiment of the release lugs shown in a neutral position.
Figure 8:
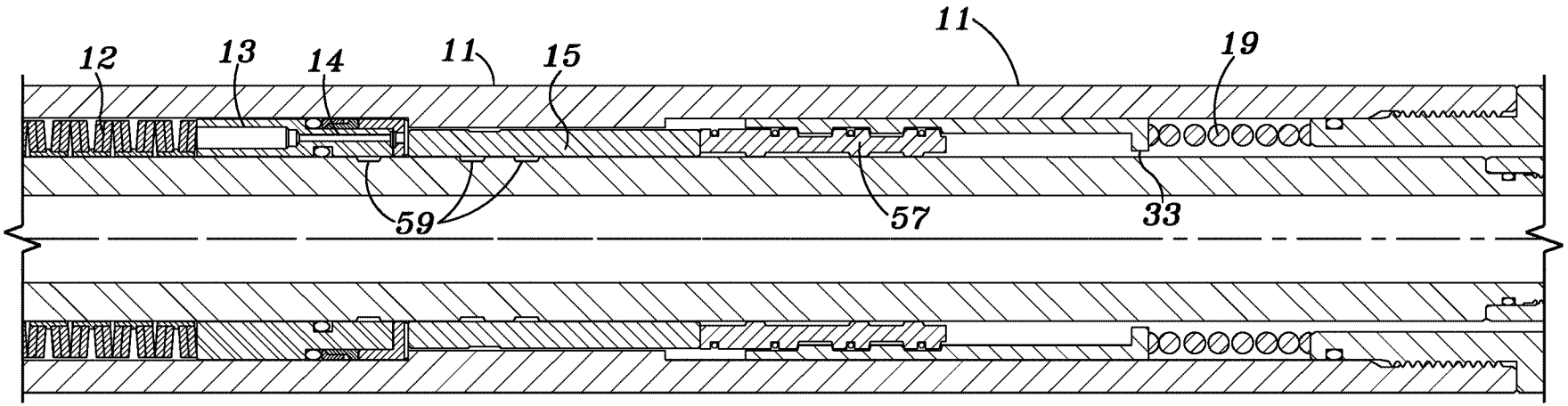
FIG. 8 is a cross-sectional view of the release lugs of the second embodiment in a fully released mode.

Spring 19 which is now compressed will move trigger sleeve 16 back to the neutral position shown in FIG. 1. In the embodiment of FIGS. 7 and 8, the release lugs 57 have been changed to include a plurality of projections 58 that are non-uniformly spaced apart from each other rather than having varying widths. The grooves 59 in the mandrel are also spaced apart accordingly to receive projections 59 in the neutral position as shown in FIG. 7. The outer surfaces of the release lugs are formed in the same fashion as the lugs shown in FIG. 5 so that in the released position of FIG. 8, surfaces 35 of the release lug are located within grooves 31 of the trigger sleeve 16.

Figure 10:
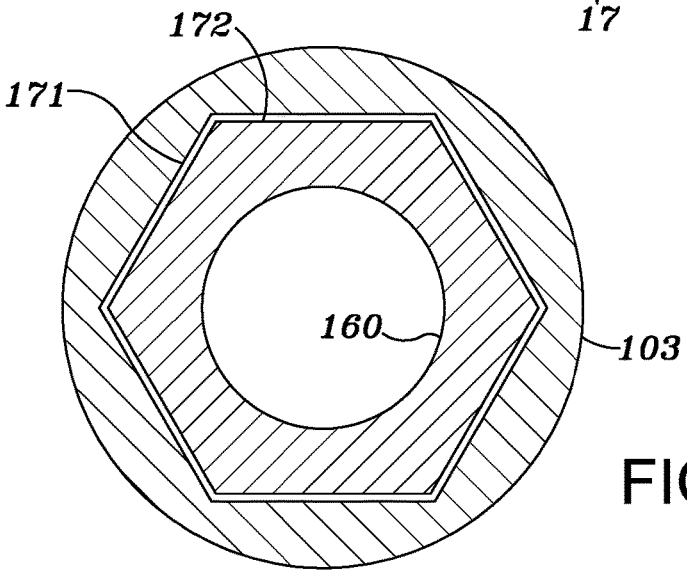
FIG. 10 is a cross-sectional view taken along line 10-10 of FIG. 9.

FIG. 9 illustrates an embodiment of a complete jarring tool that incorporates the release lugs of the embodiment shown in FIGS. 7 and 8. The jar includes a connector 100 for connecting the jar to a tubular string, upper housing members 102 and 103, lubricating fitting 104, central housing 11, a lower lubricating fitting 151, lower housing member 152 and lower connector 165. The jar also includes a Bellville spring stack 12. The housing members are threadably connected to each other at 130, 131, 132, 133, 134 and 135. The mandrel of the jar includes an upper portion 160 which is threadedly connected to connector 100, a central portion 21 and a lower portion 153. The mandrel portions are connected together by threads at 136 and 158. Suitable seals are provided at 121, 122, 123, 124, 125, 126, 129 and 139. A floating piston 127 surrounds the lower portion of mandrel 153. A lubricating material is introduced into the housing through fittings 140 and 141. The upper portion of the mandrel 160 includes an annular raised portion 138 which acts as a hammer against an anvil shoulder 137 on housing upper end member 102. As shown in FIG. 10, upper housing member 103 may comprise a hexagon surface 171 which received a hexagon outer surface 172 on the mandrel portion 160.

The jarring tool of FIG. 9 may incorporate the release lugs shown in the embodiments of FIG. 5 or that of the embodiment of FIGS. 7 and 8.

Figure 11:
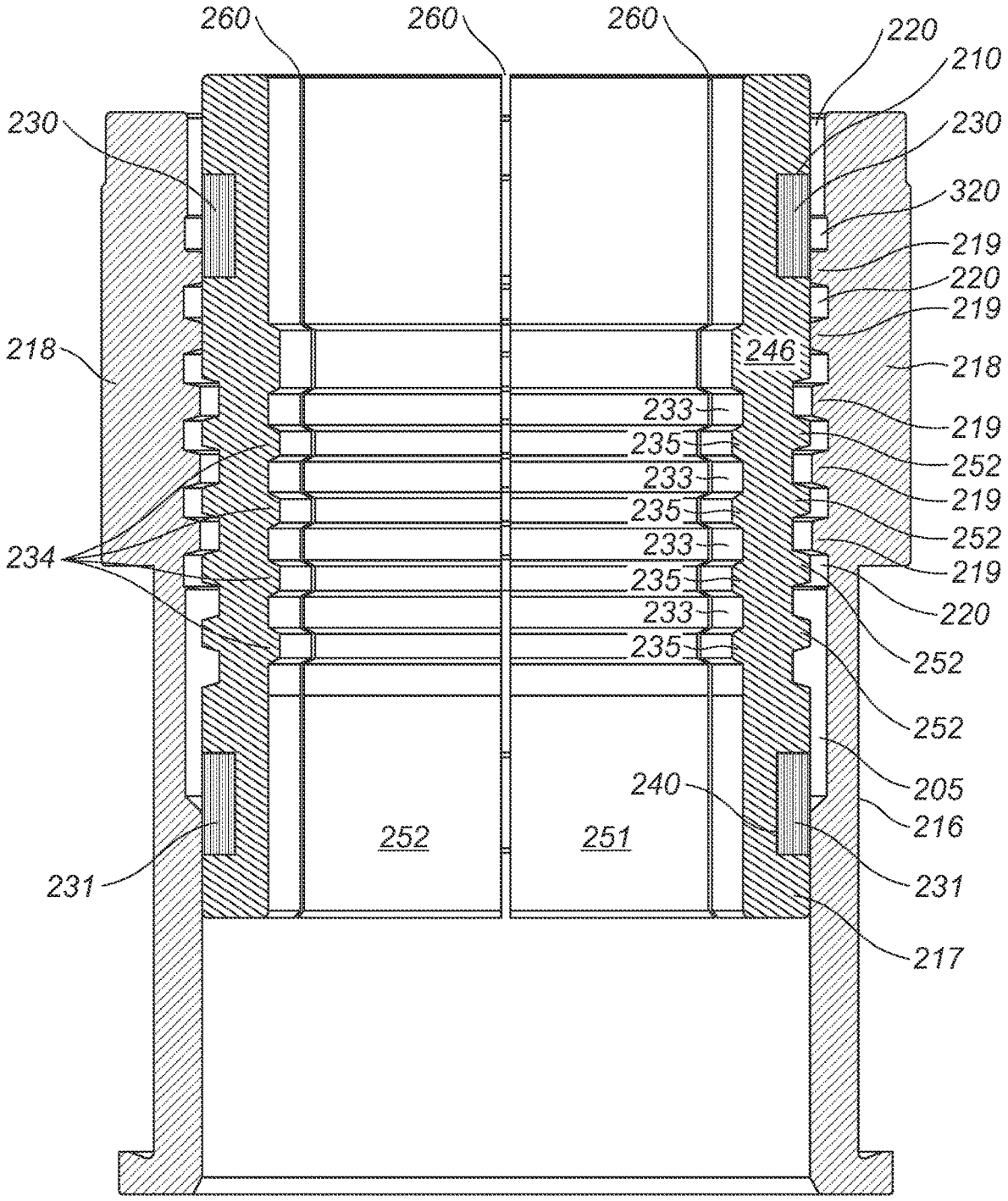
FIG. 11 is a cross sectional view of a second embodiment of a release mechanism.
Figure 12:
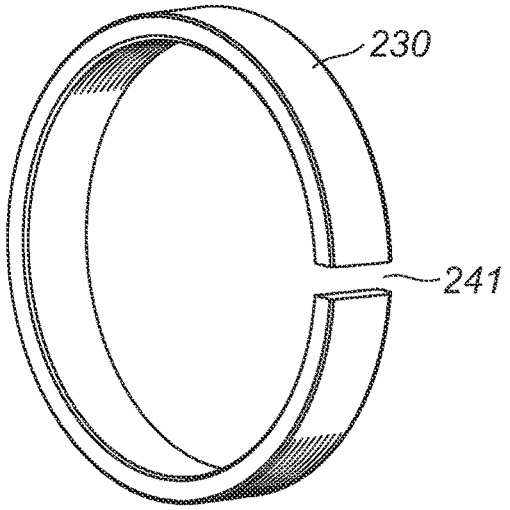
FIG. 12 is a prospective view of a spring used in the embodiment of FIG. 11.
Figure 13:
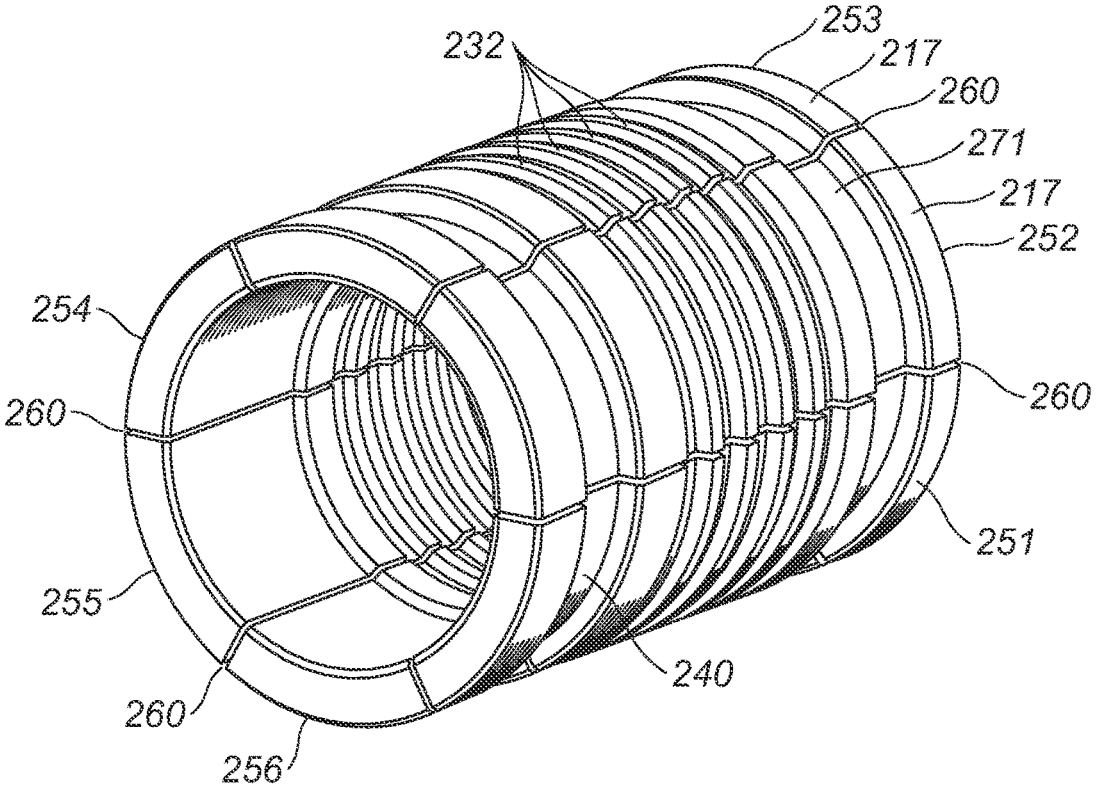
FIG. 13 is a perspective view of a portion of the release mechanism shown in FIG. 11.

FIGS. 11-13 illustrate a second embodiment of a release mechanism. Annular trigger sleeve 216 includes an annular enlarged portion 218. A plurality of arcuate release lugs 251, 252, 253, 254, 255, and 256 are positioned within the trigger sleeve 216 and are angularly spaced by gaps 260 as shown in FIG. 13. Each release lug includes a plurality of annular projections 232 and a plurality of annular grooves 234 formed between the projections on its outer surface. They are adapted to interface with an annular projection 219 and annular grooves 220 formed on the interior surface of trigger sleeve 216 when in the release mode.

Figure 2:
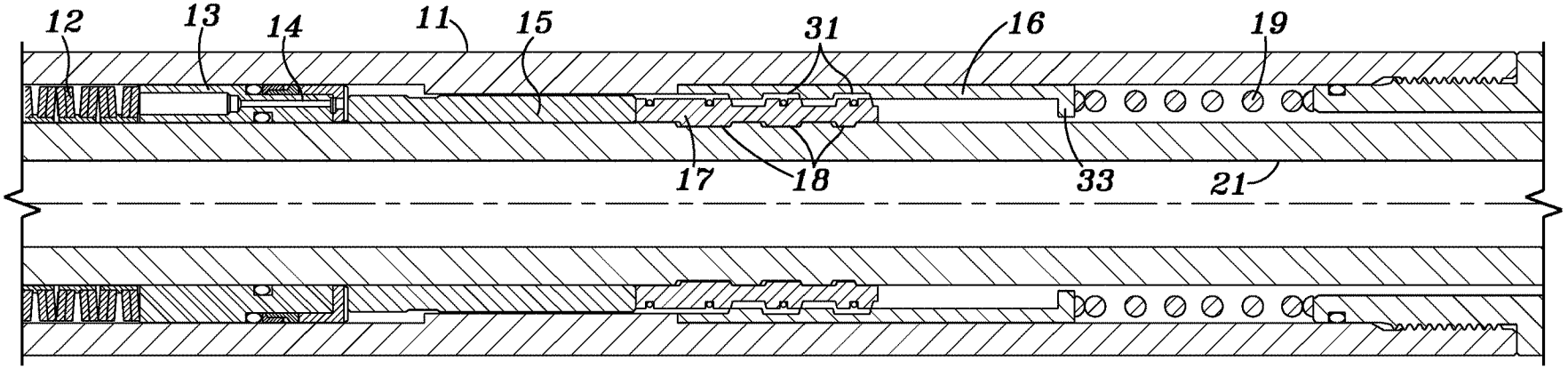
FIG. 2 is a cross-sectional view of the first embodiment of the release lugs just prior to release of the mandrel.
Figure 3:
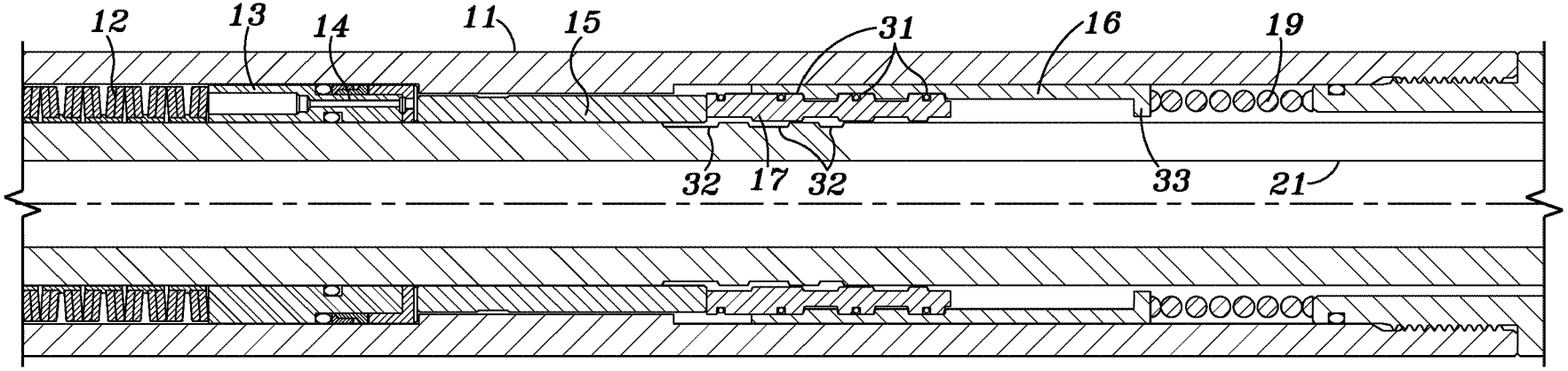
FIG. 3 is a cross-sectional view of the release lugs of FIG. 1 in a release position with the mandrel initially moving.

The interior surface of each release lug includes a plurality of angular projections 235 and a plurality of angular grooves 233 between the projections that are adapted to interface with projections and grooves formed on the outer surface of a mandrel 21 in the manner shown in FIG. 2.

Each release lug also includes a pair of grooves 240, 241 that are adapted to receive annular leaf springs 230, 231 shown in FIG. 12. Leaf springs 230 and 231 include a gap 241.

FIG. 13 is a perspective view of the release lugs in an annular array surrounding a mandrel, not shown, similar to FIG. 6.

FIG. 11 shows the release lugs in a non-release positon. As portions 246 and 217 of the release lugs, enter undercut portions 220, 205 of the trigger sleeves, release lugs 251-256 will expand outwardly thereby releasing the mandrel in a manner similar to that shown in FIG. 4.

Although the present invention has been described with respect to specific details, it is not intended that such details should be regarded as limitations on the scope of the invention, except to the extent that they are included in the accompanying claims.

The invention claimed is:

1. A system for freeing a downhole tool lodged in a well, comprising:
- the downhole tool;
- a tubular string including the downhole tool; and
- a jarring tool disposed on the tubular string, the jarring tool comprising:
  - a housing,
  - a mandrel adapted for longitudinal movement within the housing and having a plurality of axially spaced grooves on an outer surface of the mandrel;
  - an annular trigger sleeve surrounding the mandrel;
  - a plurality of arcuate release lugs positioned between the annular trigger sleeve and the mandrel, each release lug comprising an inner surface having a plurality of axially spaced projections and an outer surface having a plurality of grooves;
  - one or more springs surrounding and in contact with the release lugs; and
  - an actuating piston comprising a restrictor orifice and one or more check valves;
- wherein upon the downhole tool becoming lodged in the wellbore, the jarring tool is configured to convert a force supplied to the tubular string to a jarring force which frees the downhole tool.

2. The system of claim 1, wherein the one or more springs comprise garter springs.

3. The system of claim 1, wherein the one or more springs comprise leaf springs, each of the one or more leaf springs comprising a gap.

4. The system of claim 1, wherein the projections of the inner surface of each of the release lugs are formed having varying widths on their inner surface and are evenly spaced from each other.

5. The system of claim 1, wherein the projections of the inner surface of each of the release lugs are formed having similar widths on their inner surface and are non-uniformly spaced apart from each other.

6. The system of claim 1, wherein an inner surface of the annular trigger sleeve is provided with a plurality of projections which correspond to the plurality of grooves of the outer surface of each of the plurality of release lugs.

7. The system of claim 1, further comprising an actuating piston comprising parallel flow passages, a restrictor orifice, and one or more check valves.

8. A method of freeing a downhole tool lodged in a well, comprising:
- providing a tubular string including the downhole tool and a jarring tool, the jarring tool comprising:
  - a housing,
  - a mandrel adapted for longitudinal movement within the housing and having a plurality of axially spaced grooves on an outer surface of the mandrel;
  - an annular trigger sleeve surrounding the mandrel;

a plurality of arcuate release lugs positioned between the annular trigger sleeve and the mandrel, each arcuate release lug comprising an inner surface having a plurality of axially spaced projections and an outer surface having a plurality of grooves;

one or more springs surrounding and in contact with the arcuate release lugs; and an actuating piston comprising a restrictor orifice and one or more check valves;

deploying the tubular string in a wellbore;

supplying a force to the tubular string upon the downhole tool becoming lodged in the wellbore, thereby transferring a supplied force to the jarring tool;

converting the supplied force to a jarring force by the jarring tool; and freeing the downhole tool.

9. The method of claim 8, wherein the freeing results from a supplied force having an upward direction.

10. The method of claim 8, further comprising reloading the jarring tool after the supplying and prior to the converting.

11. The method of claim 9, wherein the reloading results from the supplied force having a downward direction.

12. The method of claim 8, wherein the converting comprises the supplied force compressing a Belleville spring stack of the jarring tool followed by the plurality of arcuate release lugs releasing the mandrel to travel within the housing.

13. The method of claim 12, further comprising aligning the plurality of grooves of the outer surface of each of the arcuate release lugs with corresponding projections of an inner surface of the annular trigger sleeve prior to the releasing.

14. The method of claim 12, wherein the releasing comprises the plurality of axially spaced projections of the inner surface of each of the arcuate release lugs disengaging from the plurality of axially spaced groves on the outer surface of the mandrel.

15. The method of claim 12, wherein the converting further comprises an annular raised portion of the mandrel acting as a hammer against an anvil shoulder of the housing after the releasing.

* * * * *